US010633238B2

(12) United States Patent
Boscaro et al.

(10) Patent No.: US 10,633,238 B2
(45) Date of Patent: Apr. 28, 2020

(54) MACHINE FOR FILLING CONTAINERS WITH LIQUIDS, PROVIDED WITH A FILLING LEVEL CORRECTION SYSTEM

(71) Applicant: MBF S.p.A., Veronella, Verona (IT)

(72) Inventors: Giuliano Boscaro, Verona (IT); Nicola Dal Monte, Verona (IT); Paolo Albertini, Verona (IT)

(73) Assignee: MBF S.p.A. (IT)

( * ) Notice: Subject to any disclaimer, the term of this patent is extended or adjusted under 35 U.S.C. 154(b) by 0 days.

(21) Appl. No.: 16/125,966

(22) Filed: Sep. 10, 2018

(65) Prior Publication Data

US 2019/0077647 A1 Mar. 14, 2019

(30) Foreign Application Priority Data

Sep. 11, 2017 (IT) ..... 102017000101252

(51) Int. Cl.
*B67C 3/28* (2006.01)
*B67C 3/26* (2006.01)
(Continued)

(52) U.S. Cl.
CPC ..... *B67C 3/282* (2013.01); *B67C 3/007* (2013.01); *B67C 3/225* (2013.01); *B67C 3/244* (2013.01);
(Continued)

(58) Field of Classification Search
CPC ..... B67C 3/282; B67C 3/007; B67C 3/225; B67C 3/244; B67C 3/262; B67C 2003/2668; A47F 1/00
(Continued)

(56) References Cited

U.S. PATENT DOCUMENTS 4,986,318 A * 1/1991 Yun ..... B67C 3/06 141/147
6,038,833 A * 3/2000 Beringer ..... B67C 3/26 141/368

FOREIGN PATENT DOCUMENTS

EP 2236454 A1 6/2010
FR 2678920 A1 1/1993

OTHER PUBLICATIONS

Italian Search Report, Italian Patent Application No. 102017000101252, dated May 29, 208.

* cited by examiner

*Primary Examiner* — P. Macade Nichols
(74) *Attorney, Agent, or Firm* — Valauskas Corder LLC

(57) ABSTRACT

The present invention relates to a machine 1 for filling containers with liquids, comprising:—a support structure;—a rotating carousel provided with a tank;—a plurality of valve groups mounted on said carousel for filling containers; and a logic control unit suitable to automatically manage the operation of the filling machine. Each valve group comprises an air return tube which is provided with an open lower end, susceptible to be inserted in a container, and an opposite upper end and can be moved axially between at least one lowered position and a raised position. Each valve group comprises: means for guiding the axial movement of the return air tube between a lower end stop and an upper end stop, wherein said at least one lowered position is between said two end stops; elastic mechanical means suitable to exercise constantly an axial thrust action on the return air tube towards the raised position;—means for reversibly blocking the return air tube in any axial position between said lower end stop and said upper end stop; and—a cam follower rigidly connected to the tube. The filling machine comprises a cam which is placed peripherally to the
(Continued)

rotating carousel at a first angular position α1 with respect to an entry station to be cyclically engaged by the cam follower. The cam is profiled so as to impose on each tube a predetermined axial displacement H towards the lower end stop and has a circumferentially limited operating angle of working Δ. The filling machine 1 comprises means for moving the cam in height. The logic control unit is operatively connected to the means for moving the cam in height and to the reversible blocking means of each return air tube and is programmed:—to command the blocking of the blocking means when the individual tube is located within the operating angle of working of the cam to keep the return air tube in the lowered position, and—to command the unblocking of the reversible blocking means of each individual air return tube at a second angular position chosen as a function of the filling operating cycle to be performed on the containers.

16 Claims, 11 Drawing Sheets

(51) Int. Cl.
*B67C 3/00* (2006.01)
*B67C 3/22* (2006.01)
*B67C 3/24* (2006.01)

(52) U.S. Cl.
CPC ..... *B67C 3/262* (2013.01); *B67C 2003/2602* (2013.01); *B67C 2003/2668* (2013.01)

(58) Field of Classification Search
USPC ..... 222/144
See application file for complete search history.

MACHINE FOR FILLING CONTAINERS WITH LIQUIDS, PROVIDED WITH A FILLING LEVEL CORRECTION SYSTEM

FIELD OF APPLICATION

The present invention relates to a machine for filling containers with liquids, provided with a filling level correction system.

The subject machine is intended to be used in industrial bottling plants to fill containers, such as in particular bottles, with liquids, particularly drinking liquids, such as wines, spirits, liqueurs, etc.

More in detail, the subject machine is of the rotary type, i.e. with rotary carousel provided with a plurality of filling valve groups, and is preferably used in bottling lines downstream of a rinsing machine and upstream of a capping machine.

The subject filling machine may be indifferently of the gravity type, under light depression or under pressure (for filling carbonated liquids, commonly called "isobaric").

BACKGROUND ART

Rotary filling machines are traditionally provided with a fixed support structure on which a rotating carousel is rotatably mounted. The latter carries a cylindrical tank, which contains a liquid to be bottled. In particular, the tank is filled with the liquid to be bottled up to a certain level, above which it is filled with an inert gas (such as nitrogen). This inert gas is maintained substantially at atmospheric pressure in the case of gravity filling machines, under light vacuum in the case of lightly depressed filling machines and under pressure in the case of "isobaric" filling machines.

Below the tank there are peripherally fixed a plurality of valve groups for conveying the liquid contained in the tank inside the underlying containers to be filled, such as in particular bottles, resting on corresponding support plates.

Each valve group comprises a supply duct in communication with the tank, and intercepted by a shutter which adjusts the inflow of liquid from the tank to the underlying container.

Each valve group is provided with a drainage duct of gas coming out from the container during filling.

Operationally, the container is hydraulically associated with the corresponding valve group, by raising the corresponding support plate, with the mouth of the container being brought into a sealing relationship with the supply duct of the valve group.

The supply duct shutter is then opened to allow the liquid to be dispensed into the container, and the air present in the container is conveyed into the tank or a drainage circuit (at the same pressure as the tank).

Depending on the criterion by which the filling of the container is interrupted, we can distinguish weight, volume and level filling machines.

In level filling machines, the container is filled up to a predetermined distance from its opening, a distance called "level", established by the manufacturer of the container itself. When the container is filled at this level, the volume of product contained is equal, within certain tolerances always indicated by the manufacturer of the container, to the volume of liquid indicated on the label of the product sold.

The level may be obtained "hydraulically" or by an "electronic" control.

In "hydraulic" filling valves, the end of liquid transfer is determined by hydraulic effects, regardless of the closing of the shutter. In these valves, the air drainage duct comprises a tube which is inserted into the container during filling and through which the air exiting the container passes. This tube (referred to as "air return tube") is provided with an open lower end, which is destined to be inserted into the container to be filled, and an open upper end which is fluidically connected to the tank or to a possible drainage circuit, to convey the air coming from the container during the filling in the latter. When the liquid dispensed into the container reaches the lower end of the return air tube, thus blocking it, the gas in the container can no longer exit and the flow of liquid is stopped. In this situation, a residual amount of the liquid rises inside the return air tube, up to reaching the same level as the level of the liquid in the tank according to the known principle of communicating vessels, thus causing the interruption of the supply of the liquid in the container.

Also in the "electronic" filling valves there is a duct for the drainage of the gas, which—unlike "hydraulic" level valves—does not necessarily include a tube intended to be introduced into the container. A probe or an ON/OFF sensor is instead introduced in the bottle. When the liquid poured into the container reaches the established level, the sensor "commands" the closing of the shutter, thus interrupting the descent of the liquid.

In isobaric filling machines, each valve group may be provided with: a first valve which can be actuated to connect, the air drainage duct (and in particular the return air tube, if present) to a suction circuit to perform a pre-drainage step of the air in the container; a second valve that can be operated to connect the return air tube to the tank during the tank pressurization and filling steps; and a third valve which can be operated to connect the return air tube to a drainage circuit (separated from the tank) to perform the decompression (degassing) of the container after the filling step.

In the following description, the term "level element" refers indistinctly to the return air tube, present in "hydraulic" level machines, or to the level probe/sensor, present in "electronic" level machines.

As is known, the filling machines described above must satisfy a series of operational requirements, which are discussed in detail below.

Accuracy of the Filling Level:

the levels obtained by positioning the return air tube or by means of a level sensor have a fairly coarse precision and repeatability. To improve the accuracy and repeatability in the execution of the correct level, a level correction function may be introduced. This function, described for example in EP0337913A2, envisages the introduction of pressurized gas into the container at the end of the filling in order to expel the liquid that has filled the bottle over the lower end of the tube through the return air tube itself. This correction technique is widespread in hydraulic level valves, although in principle it may also be extended to electronic level valves.

Automatic Format Change:

filling machines are required to process containers of different shapes, sizes and materials, and to be capable of switching from one format to another, minimising format change times and operator intervention. In particular, filling machines are required to automatically change the level height of the product poured in the bottle according to the filled container. Sometimes, this adds to the need for the level to vary, even with the same container, depending on the filling temperature of the treated product.

Protection of the Level Element:

In modern filling machines, the level element, be it a tube or a sensor, may be subject to damage due to collisions with the containers or bursting thereof. These damages cause the production to be interrupted to replace the element, thus causing the plant to lose productivity and introducing risks of contamination, as well as involving an often costly machine component. In order to prevent these damages, the valve level element is brought into the safe position until the container is correctly sealed with the supply tube of the relative valve group or the risk of burst is overcome, which may occur for example during the pressurization of the container in isobaric filling machines.

High Productivity:

In rotary filling machines, not all the valves present work simultaneously but, as will be clearer below, a portion of them is in the "dead" zone, that is, they occupy a sector in which no containers are ever present. More precisely, a starting point of the working angle is identified, at which point the containers arrive at the filling machine and enter sealed with the members of the respective valve, and an end point of the working angle, where the containers lose the seal with the valve members to exit the filling machine. The angle that joins these two points is called the "working angle" of the filling machine and encloses all the valves that are simultaneously processing the containers. The larger the working angle, the greater the productivity of the turret. One way to increase the working angle of filling turrets is to reduce the vertical travel that the containers must carry out, starting from the transfer plane thereof, to seal with the valve members. For this purpose, the more the level element is raised relative to the position corresponding to the level in the bottle, the less the displacement that the container will have to perform at the inlet and outlet of the filling machine.

Flexibility in Lifting the Return Air Tube:

to increase the productivity of the isobaric filling machines, which process carbonated drinks, one must also try to optimize the filling cycle, which as already mentioned includes the degassing step, i.e. decompression of the container. This object, as described in the Italian patent application PR92A000015, is obtained by decompressing the liquid present in the container with the level tube not in contact with the liquid, so as to also prevent the perturbation of the liquid in the container. The filling machine valves must therefore be capable of lifting the return air tube when the decompression step begins. The starting point of said step within the turret working angle is not fixed, as it depends on the working speed of the machine itself, and therefore the lifting of the level element must be "movable" in space.

The above operational requirements have all been met over the years in various ways, gradually increasing the degree of automation. If this made it possible to increase operational flexibility, it also increased the complexity and cost of filling machines. The increased automation of the machines has also implied greater risks in terms of reliability thereof.

Patent application EP0337913A2 describes a mechanical control isobaric filling machine. This machine is provided with filling valves with movable level tube and level correction system. The movement of the tube is generated by a cam follower integral with the tube itself, which engages a vertically adjustable annular cam. The cam is arranged along a circumference close to that on which the filling valves are located and is vertically moved by adjustment systems, which allow level adjustment during format change. This filling machine, managed by purely mechanical systems, allows a level correction in the bottle, a quick change in format, and a safe and reliable positioning of the level tubes. The main limitations of this machine lie in that the return air tube is not extracted from the bottle during the decompression step due to the conformation of the filling valve and in that, in any case, it is not possible to manage in a flexible manner the lifting moment of the tube when operating requirements change, as this operation is managed by angularly fixed cams.

The limits of the filling machine described in EP0337913A2 are partly overcome by the Italian patent application PR92A000015 which describes a filling machine with filling valves provided with a return air tube completely independent of the shutter, in which the decompression of the container may be carried out without having the level tube in contact with the liquid. More in detail, the turret is provided with a positioning system of the level tube comprising two devices. A first device consists of an annular abutment, in common with all the filling valves installed in the turret, which determines the level in the bottle. The second device moves the individual tube/sensor up to the level position. Operationally, the first device is used for setting the machine, normally when the format is changed before starting production. If motorized, the first device could be used to adjust to the temperature variation of the level itself. The second device consists of a pneumatic cylinder and is designed to move the single tube at each filling cycle. The mechanical activation of the cylinder of each tube by means of one or more cams suitably positioned peripherally to the turret. The position of said cams is fixed, but may be adjusted manually by the operator when setting the filling machine.

The machine described in PR92A000015, similarly to that described in EP0337913A2, does not allow a flexible management of the lifting of the tube as the operating requirements vary, as this operation is managed by means of cams. Another limitation lies in the use of the common abutment ring which, in order to be moved, requires a certain number of lifting columns connected kinematically to each other and arranged along the primitive circumference of the filling machine. "Primitive circumference" means the circumference on which the filling valves of the filling machine are arranged.

Patent EP1457457B1 has a filling valve for filling machines, also provided m this case with a level tube movable independently of the shutter. Also in this case, the tube through suitable means engages an annular cam which may be mounted on a fixed base and move vertically in a controlled manner with respect to the filling valves. The system allows the adjustment of the levels during format change (the levels may be stored in the machine control unit), as well as any movement of the level tube during the working cycle, if the cam is suitably shaped. The machine therefore allows speed in the format change, but not the optimization of the decompression step since in this case too, the tube is lifted by the cam into a fixed point independently of the rotation speed of the machine itself. Moreover, in the filling machine described in EP1457457B1, the means for transmitting the movement to the tube and the presence of an annular abutment cam make the system complex and expensive.

Italian patent application VI2005A000310 describes a filling machine with a higher degree of automation, which in particular allows a flexible management of the lifting of the tubes. More in detail, the filling machine is provided with movable tube filling valves in which the positioning of the tube is still entrusted to two devices: a ring concentric to the filling machine (mounted on board the rotating part of the machine, which acts as a reference determining the level in the bottle), and an individual movement system consisting of an electrically driven pneumatic cylinder. Compared to the solution described in PR92A000015, the electric rather than mechanical drive of the cylinders allows the tube to be moved up and down in a variable point in space. In this way, there is a greater functional flexibility of the filling valve, notwithstanding the constructive complexity and the reduced reliability of the system of PR92A000015, which are linked to the use of pneumatic cylinders, subject to wear, and to the need for a common abutment ring for all the valves, adjustable in height by means of a plurality of lifting columns to be controlled in synchronism or to be coordinated with a special kinematic chain.

The maximum level of flexibility is achieved with the filling machine described in patent application DE102005003222A1. Each filling valve is provided with a linear motor, adapted to position and move each level tube independently of the tubes of the other filling valves. In this way, maximum control flexibility is achieved, thus making the use of a common abutment ring unnecessary. The drawback of this solution is linked to the high construction cost. The use of electric motors also introduces problems related to the precision and repeatability of positioning of the level tube of the different valves and for each container processed by the same valve.

In conclusion, the degree of automation of the proposed solutions has grown over the years, but the complexity and cost of the solutions have also increased.

Disclosure of the Invention

In this situation, the problem at the basis of the present invention is that of overcoming in whole or in part the drawbacks of the prior art by providing a filling machine for containers with liquids provided with a system for correcting the filling level which meets to the operational needs highlighted above, in a simpler, more reliable and cost-effective manner, compared to the currently available solutions.

In particular, the object of the present invention is to provide a filling machine for containers with liquids provided with a filling level correction system which is capable of automatically adjusting the filling level according to the format of the containers.

A further object of the present invention is to provide a filling machine for containers with liquids provided with a filling level correction system which allows managing the lowering of the return air tubes in an automatic and flexible manner without having to provide each tube with a pneumatic cylinder or an electric motor.

A further object of the present invention is to provide a filling machine for containers with liquids provided with a filling level correction system which allows adjusting all the valve groups at the same filling level without using a common annular abutment and without even providing each valve group with an electric motor.

BRIEF DESCRIPTION OF THE DRAWINGS

The technical features of the invention, according to the aforesaid objects, can clearly be seen in the content of the claims below, and its advantages will become more readily apparent in the detailed description that follows, made with reference to the accompanying drawings, which illustrate a preferred embodiment, which is purely exemplary and not limiting, in which:

DETAILED DESCRIPTION

Figure 1:
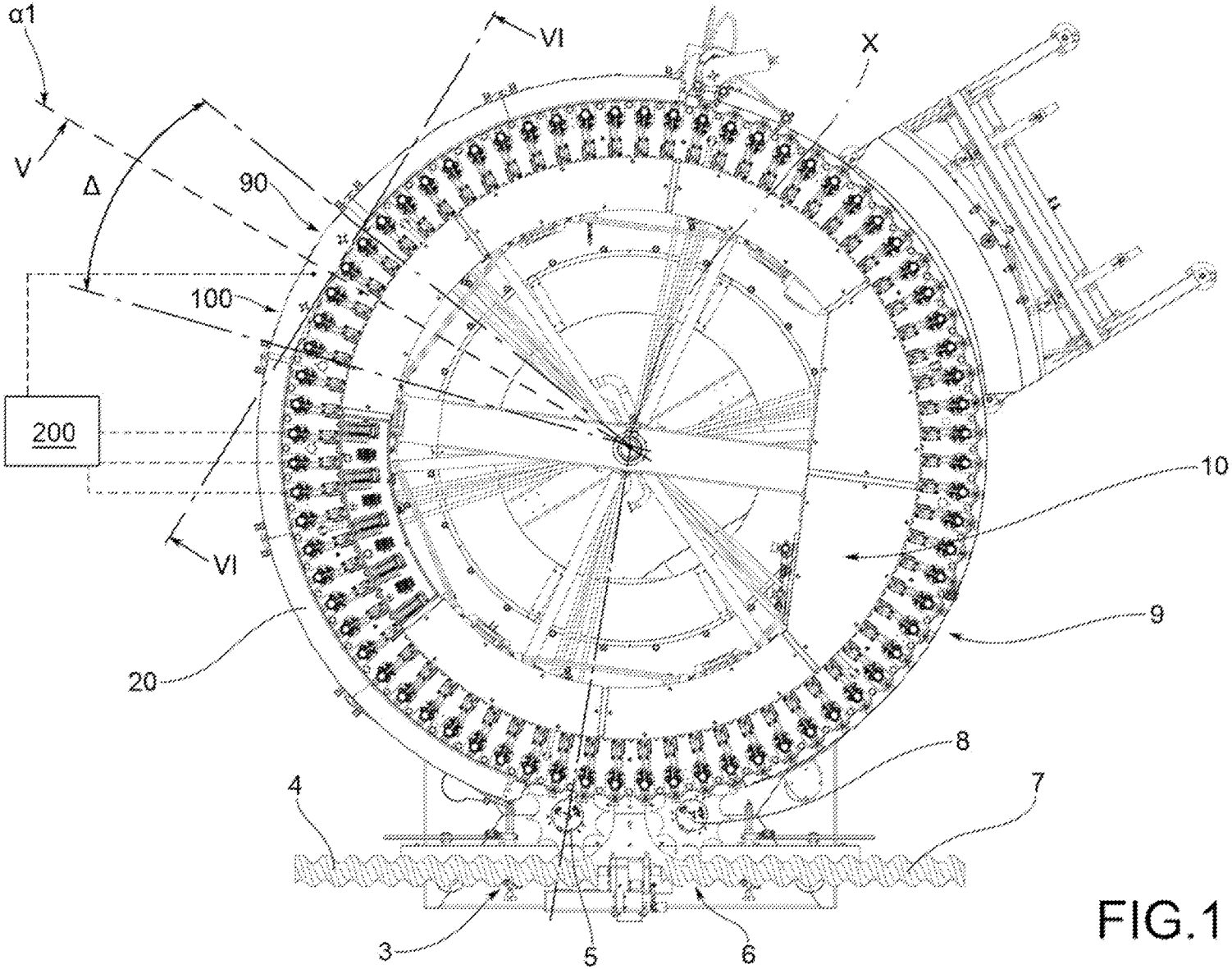
FIG. 1 shows a schematic plan view of the filling machine object of the present invention.
Figure 2:
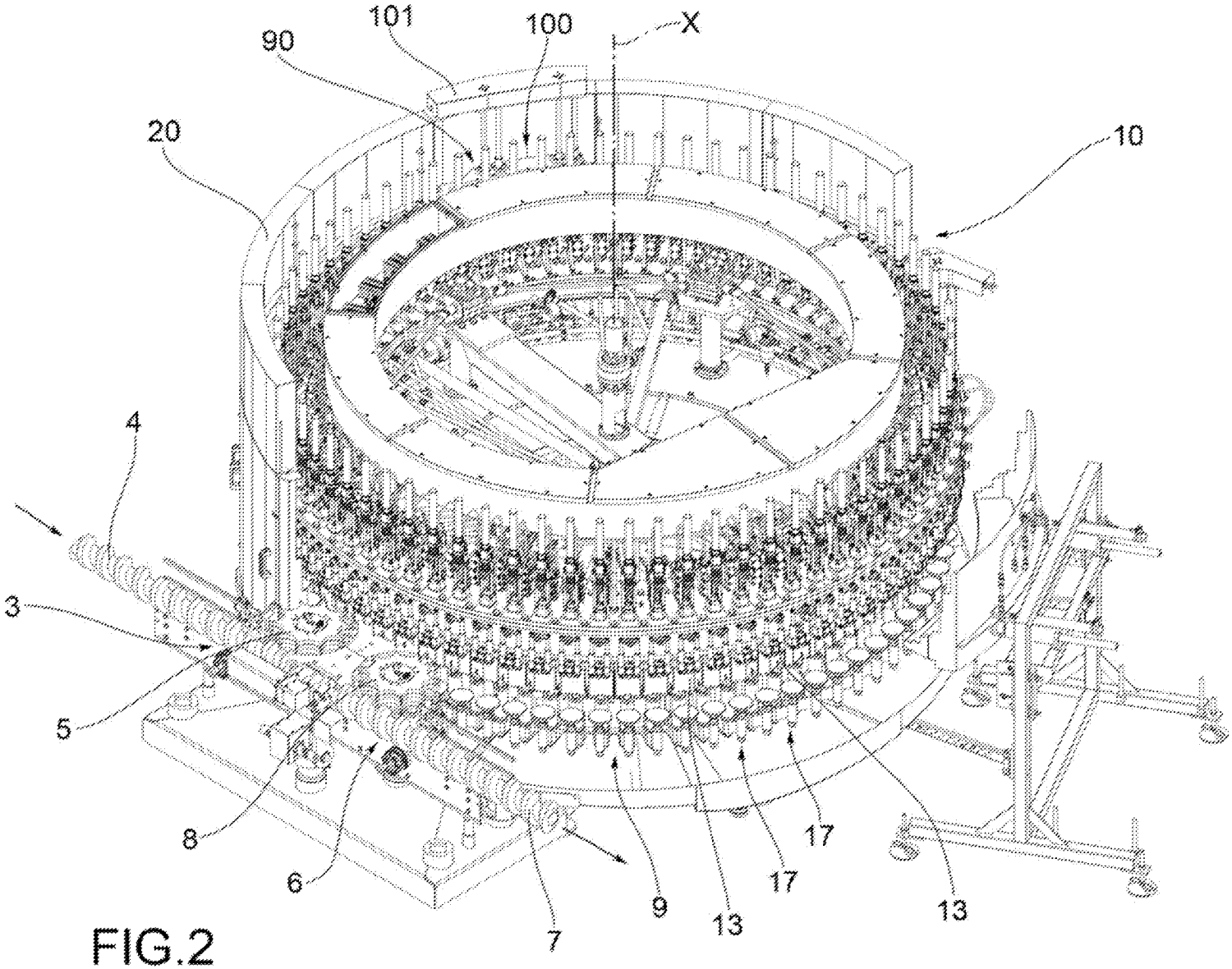
FIGS. 2 and 3 show two different perspective views of the filling machine illustrated in FIG. 1.

With reference to the accompanying drawings, reference numeral 1 indicates as a whole the machine for filling containers with liquids provided with a system for correcting the filling level object of the present invention.

It is intended for bottling containers 2 with drinking liquids, either carbonated or not carbonated.

The subject filling machine 1 is inserted, in a completely traditional manner, in a bottling plant or line provided with several machines that work in succession, and is positioned in particular downstream of a rinsing machine and upstream of a capping machine. The containers 2 are transferred from one machine to another by means of conveying lines, such as for example conveyor belts, or by means of transport equipment such as for example star wheels, screw conveyors, etc.

More in detail, with reference to the embodiment illustrated in FIG. 1, the filling machine 1 is conventionally provided with an entry station 3, in which it receives the containers 2 to be filled from a first conveyor line 4 (for example, a first star wheel 5), and an exit station 6, in which the filled containers 2 are released to a second conveying line 7 (by means of, for example, a second star wheel 8) to be conveyed towards a downstream machine, such as example a capping machine.

The filling machine 1 is provided with a support structure 9, on which a rotating carousel 10 is rotatably mounted, brought in rotation around an axis of rotation X by means of known motor means (not shown).

The rotating carousel 10 is provided with a tank 12, preferably of an annular shape, inside which the liquid to be bottled is contained. In particular, the tank 12 is filled with the liquid to be bottled up to a certain level, above which an inert gas (such as nitrogen) is introduced. This inert gas is kept substantially at atmospheric pressure when the filling machine 1 is of the gravity type, under light vacuum when the filling machine 1 is of the type under slight depression and under pressure when the filling machine 1 is of the "isobaric" type for the treatment of carbonated liquids.

The rotating carousel 10 carries peripherally mounted a plurality of valve groups 13, uniformly distributed along its circumference, and adapted to transfer the liquid from the tank 12 to the underlying containers 2 to be filled, generally consisting of glass or plastic bottles.

In particular, the rotating carousel 10 comprises a support base (not shown in the figures) which is rotatably associated with the fixed support structure 9, preferably by means of a fifth wheel (not shown). In turn, the base supports the tank 12 by means of a plurality of columns which have the function of varying the distance between the base and the tank according to the height of the containers 2 to be filled.

The support base furthermore has peripherally support means 17 for supporting the containers with respect to the valve groups 13 associated with the tank. These support means 17 can be actuated to move between a first position, in which they bring the mouth 2' of the container 2 in sealing relation with an supply duct 14 of the corresponding valve group 13, and a second position, in which they receive the container 2 when they pass through the entry station 3 of the filling machine 1. In particular, the support means 17 of the containers 2 comprise a plurality of support plates 18, mounted peripherally on the rotating carousel 10 below the corresponding valve groups 13 and intended to receive the containers 2 in support during their operating run on the rotating carousel 10.

Preferably, during the rotation of the rotating carousel 10, each support plate 18 is driven to move between the aforementioned first position and the aforementioned second position by means of a fixed cam (not shown), arranged around the rotating carousel 10, and acting with a shaped profile thereof on a cam follower 19 (consisting for example of an idle wheel) fixed to the corresponding support plate 16. The support means 17 are of the traditional type and, being well known to a man skilled in the art, will not be described in more detail.

The subject filling machine 1 comprises a logic control unit 200 (preferably comprising a PLC) suitable for automatically managing the operation of the filling machine.

The rotating carousel 10 comprises a plurality of manifolds and circuits with process fluids. These manifolds and circuits are functional for carrying out the various operating steps envisaged by the filling cycle of the filling machine 1. For this purpose, each valve group 13 is fluidically connected to the aforementioned plurality of circuits and manifolds by means of suitable control valves indicated as a whole with V in the accompanying figures.

The control valves V of each valve group 13 are preferably of the pneumatic type, and are actuated by the injection of pressurized gas from a source of pressurized gas (not shown) controlled by the logic control unit 200 of the filling machine 1.

Preferably, when the filling machine 1 is intended for filling with carbonated liquids (i.e. it is of isobaric type), the operating steps of the filling cycle are as follows:

step 1): entry of container 2 into the filling machine;

step 2): sealably matching the container 2 to a filling valve group 13;

step 3): vacuum and inertization of the container 2;

step 4): pressurization of the container 2;

step 5): Filling of the container 2;

step 6): Correction of filling level in the container 2;

step 7): Decompression (or degassing) of the container 2; and step 8): separation of the container from the valve group;

step 9): exit of the container from the filling machine.

Generally, when the filling machine 1 is of the gravity type or under light vacuum, steps 4) and 7) are not provided.

The operating steps listed above are all well known to a man skilled in the art and will therefore not be described in greater detail.

Preferably, depending on the filling cycle which the filling machine must perform, the rotating carousel 10 of the filling machine 1 may therefore comprise all or part of the following circuits or manifolds:

a vacuum circuit (for the vacuum step 3);

a circuit with inert gas (for the inertization step 3);

a first circuit with pressurized gas (for the pressurization step 4);

a second circuit with pressurized gas (for the level correction step 6);

at least one manifold for pressure relief in the container (for the depressurization step 7).

a drainage manifold of the air exiting the container during filling, as an alternative to the tank;

a collector for collecting the liquid expelled from the container during the level correction step 6), as an alternative to the tank.

More in detail, each valve group 13 responsible for filling the containers 2 comprises:

a supply duct 14 hydraulically connected to the tank 12 for the inflow of the liquid from the tank 12 into the underlying containers 2 to be filled; and a shutter 15 placed to intercept the supply duct 14 to adjust, the inflow of the liquid into the containers 2.

Preferably, the shutter 15 of each valve group 13 is driven by a double-acting pneumatic cylinder controlled by the logic control unit 200.

Each valve group 13 further comprises a return air tube 16 mounted coaxially within the supply duct 14. The return air tube 16 is provided with an open lower end 16' susceptible of being inserted into the container 2 for hydraulically adjusting the maximum level of the liquid in the container 2 itself during the filling of the latter, and with an upper end 16" opposite the lower end 16', and preferably positioned above a lid 12' of the tank 12. The upper end 16" of the return air tube may be hydraulically connected to the tank 12 or to a separate drainage circuit. The return air tube 16 may be moved axially between at least one lowered position and one raised position, independently of the shutter 15.

Operationally, a container 2 associated with a valve group 13 in its operating run on the rotating carousel 10 will be subjected in sequence to the various operating steps. Each operating step develops itself in a specific angular sector between the entry station 3 and the exit station 6.

More in detail, the return air tube 16 of each valve group 13 is moved in lifting and lowering as a function of the operating step being performed by the corresponding valve group 13.

During the filling step 5), the return air tube 16 allows the air in the container 2 to escape. During this step, the tube 16 can be fluidically connected to the tank 12 to discharge the air coming from the container therein or with a separate drainage circuit to prevent the air coming from the container from contaminating the tank.

During the level correction step 6), the return air tube 16 allows the expulsion of the excess liquid which may have filled the container beyond the positioning portion of the lower end of the return air tube. During this step, the tube 16 may be fluidically connected to the tank 12 to discharge the liquid expelled from the container therein, or to a separate drainage circuit to prevent the liquid expelled from the container from contaminating the tank.

Preferably, the return air tube 16 is maintained in the raised position from the entry step 1) of the container into the filling machine 1 up to and including the pressurization step 4). This is functional to increase the working angle of the filling machine, to reduce the risk of collisions of the tube against the container and to protect the tube from possible bursts of the container itself. The tube 16 is then brought to a lowered position (established as a function of the filling level to be obtained in the container) during the filling step 5), preferably before the end of this step 5) and is maintained in this position for the whole step 6) of correction of the filling level.

If a decompression step 7) is provided, the tube 16 is returned to the raised position before carrying out such a step 7), in order to carry out the decompression of the container with the lower end 16' of the tube 16 not in contact with the liquid. If, however, a decompression step 7) is not provided, the tube 16 is in any case returned to the raised position before carrying out the step 6) of separating the container from the valve group.

According to a first essential aspect of the present invention, each valve group 13 comprises:

means 50 for guiding the axial movement of the return air tube 16 between a lower end stop and an upper end stop, elastic mechanical means 60 suitable to exercise constantly an axial thrust action on the return air tube 16 towards said raised position;

means 70 for reversibly blocking the return air tube in any axial position between said lower end stop and said upper end stop; and a cam follower 80 (for example consisting of an idle wheel) rigidly connected to the return air tube 16.

The aforesaid at least one lowered position of the return air tube (which fixes the filling level in the containers 2) is included between the two end stops defined by the axial guide means 50.

As will be resumed hereinafter, the reversible blocking means 70 of the return air tube consist of electro-actuated devices in order to allow the control thereof through the logic control unit 200.

According to another essential aspect of the present invention, the filling machine 1 comprises a cam 90 which is placed peripherally to the rotating carousel 10 at a first angular position $\alpha 1$ with respect to an entry station 3 of the containers into the filling machine to be cyclically engaged by the cam follower 80 of each valve group 13.

Figure 4:
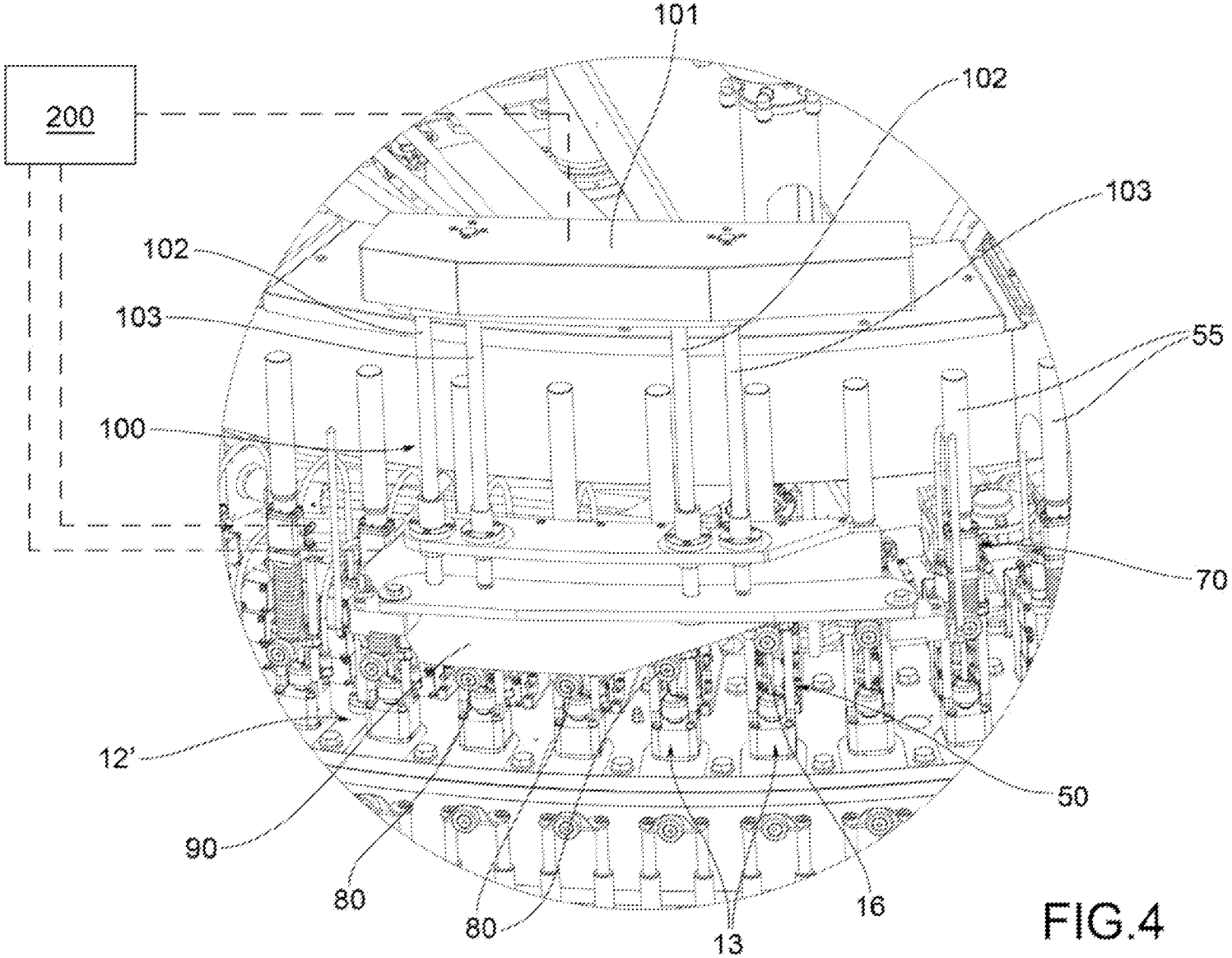
FIG. 4 shows an enlarged view of a detail in FIG. 3 (with some parts removed to better highlight others) regarding a cam for positioning the return air tubes of the filling valves.
Figure 5:
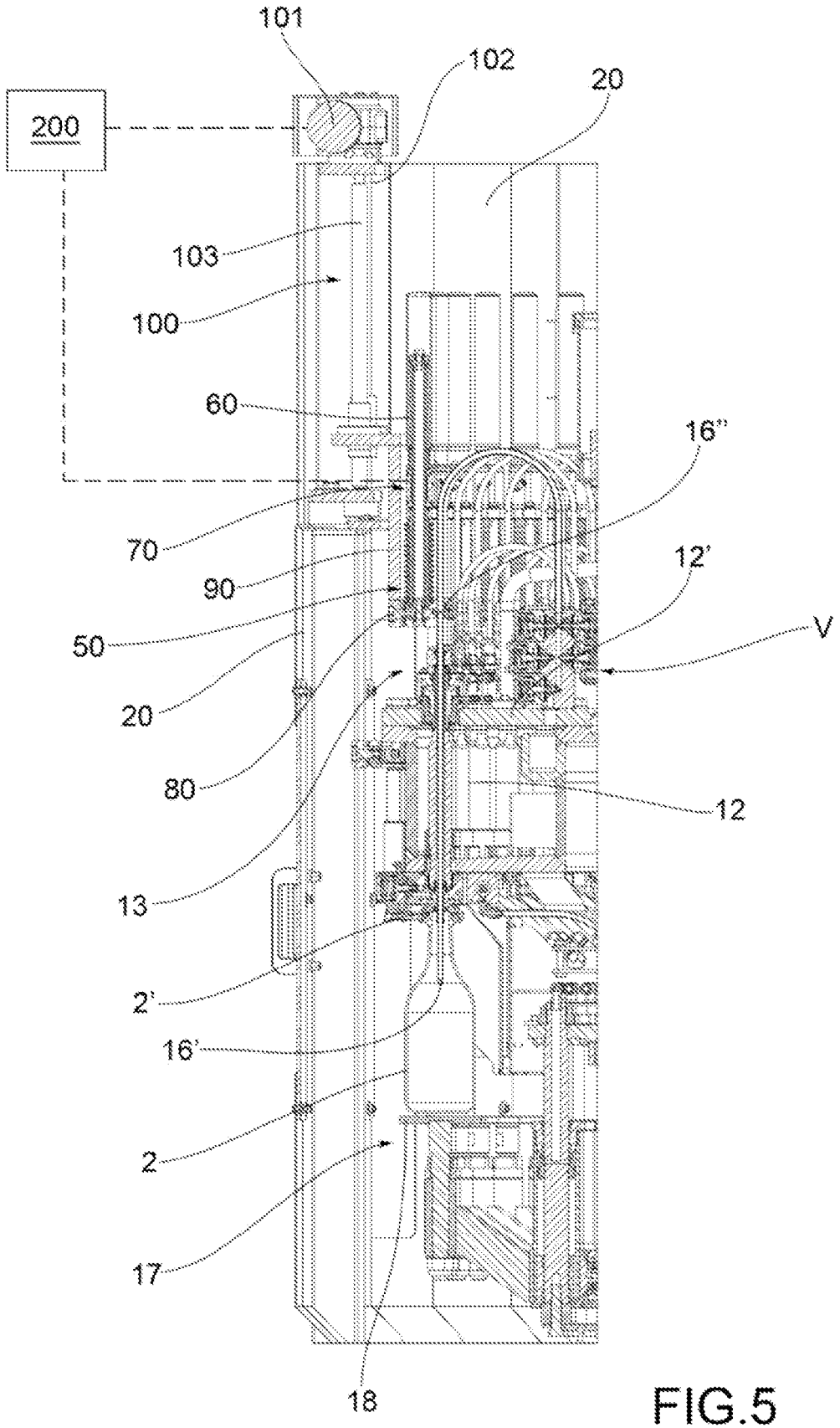
FIG. 5 shows a sectional view of a detail of the filling machine in FIG. 1, taken along to the section plane V-V indicated in FIG. 1.
Figure 6:
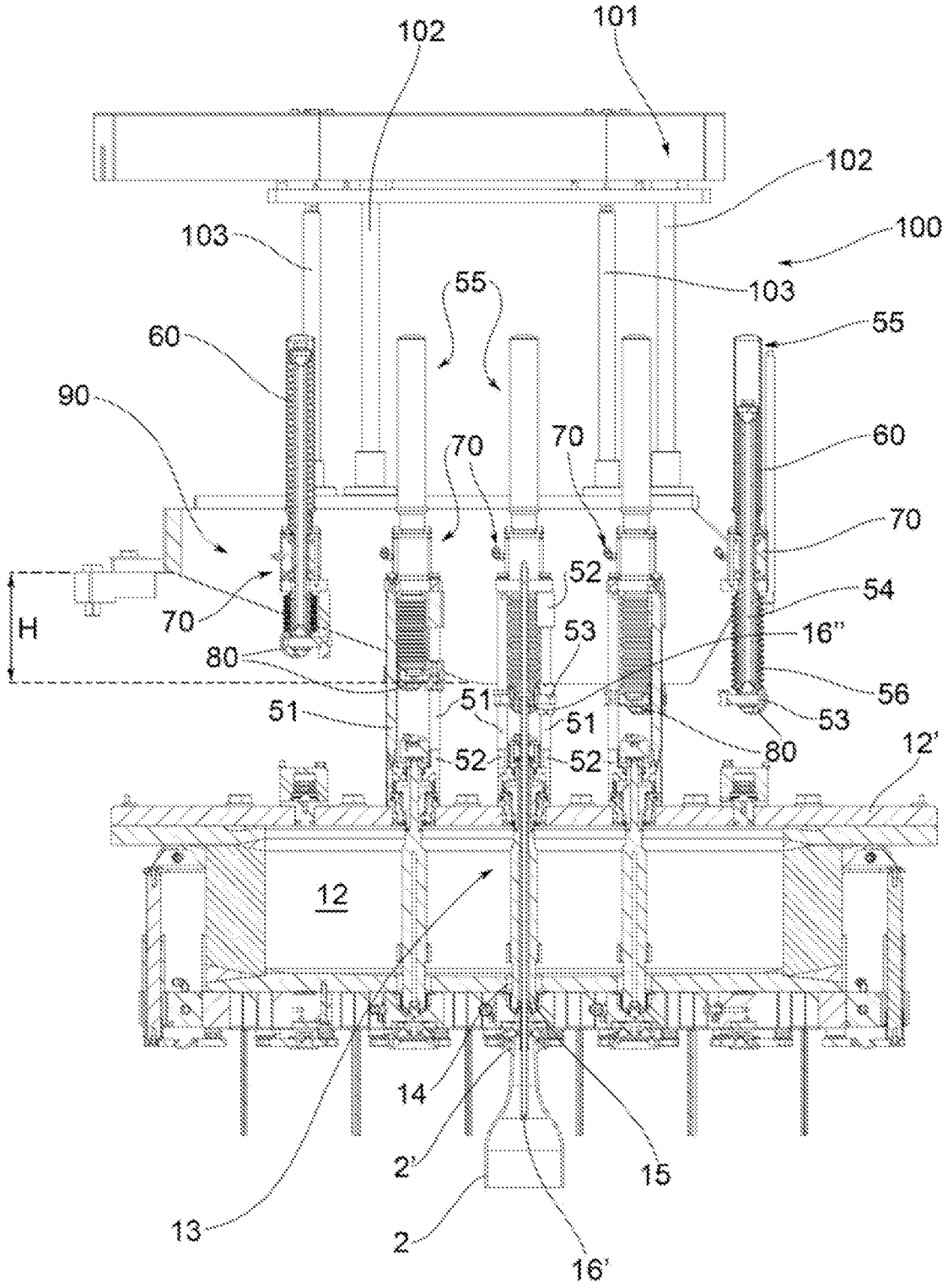
FIG. 6 shows a sectional view of a detail of the filling machine in FIG. 1 (with some parts removed to better highlight others), said section being taken along the section plane VI-VI indicated in FIG. 1.
Figure 7:
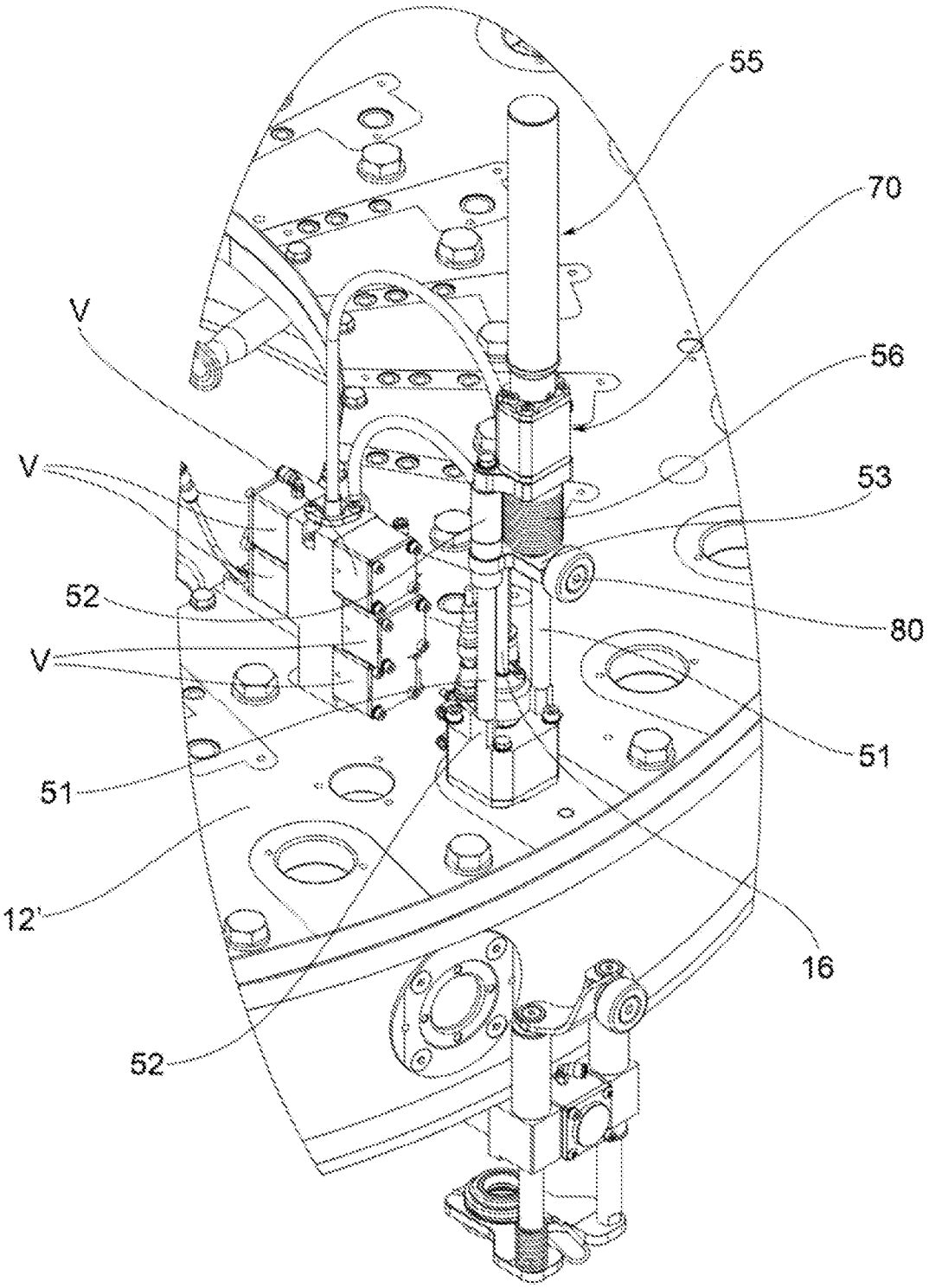
FIG. 7 shows a perspective view of a detail of the filling machine in FIG. 2 with some parts removed to better highlight others, regarding a single filling valve, illustrated with the return air tube in a raised position.

As shown in particular in FIGS. 4 and 6, the cam 80 is profiled so as to impose on each tube a predetermined axial displacement H through the respective cam follower 80 from a position corresponding to the upper end stop towards the aforesaid lower end stop, overcoming the opposite thrust of the aforesaid elastic mechanical means 60. In this way, the cam 90 positions the tube 16 in a lowered position with respect to the position corresponding to the upper end stop.

The cam 90 has an operating angle of working $\Delta$ which covers only a portion of the circumferential extension of the rotating carousel 10.

According to the invention, the filling machine 1 comprises means 100 for moving the cam 90 in height with respect to the support structure 9. Those means 100 therefore allow adjusting the height corresponding to the aforementioned lowered position imposed by the cam 90 to each individual return air tube 16.

According to a further essential aspect of the present invention, the logic control unit 200 is operatively connected to:

the means 100 for moving the cam 90 in height to automatically adjust the height corresponding to the aforementioned lowered position, so as to allow an automatic format change; and the reversible blocking means 70 of each return air tube so as to control the intervention thereof in blocking and unblocking.

According to the invention, the aforementioned logic control unit 200 is programmed to command the blocking of the reversible blocking means 70 of each individual return air tube 16 when the individual tube 16 is located within the operating angle of working $\Delta$ of the cam 90 to keep the return air tube 16 in the lowered position which it was brought to by said cam itself, opposing the action of the elastic mechanical means 60 once the relative valve group 13 has exited the operating angle of working $\Delta$ of the cam 90.

According to the invention, the aforementioned logic control unit 200 is further programmed to command the unblocking of the reversible blocking means 70 of each individual air return tube 16 at a second angular position $\alpha 2$ chosen as a function of the filling operating cycle to be performed on the containers, so as to allow the return of the individual tube 16 to the raised position under the action of the relative elastic mechanical means 60.

The aforementioned second angular position $\alpha 2$ is located downstream of the first angular position $\alpha 1$ and upstream of the exit station 6 of the containers from the filling machine with respect to the rotation direction of the carousel 10.

Advantageously, the logic control unit 200 is provided with a user interface (not shown), through which it is possible to input data relating to the features of the optimal operating cycles for each container format into a memory unit.

The invention is based on a combination of mechanical devices and electromechanical devices that allows combining the typical reliability of mechanical cam systems with the typical flexibility of electromechanical systems, without however requiring the use of pneumatic cylinders or electric motors (extremely flexible, but very expensive and less reliable than mechanical systems) for moving the return air tubes, an essential aspect for an automatic management of the format change and optimization of the filling cycle of the filling machine.

More in detail, as described above, the positioning of all the return air tubes 16 is in fact obtained by means of a single cam 90, which is adjustable in height automatically. Operationally, the adjustment of the filling level is thus obtained in a simpler and more reliable and less expensive manner compared to prior art solutions which require a pneumatic cylinder or an electric motor for each tube.

As already pointed out, this single cam 90 has an operating angle of working $\Delta$ which covers only an extremely reduced portion of the circumferential development of the rotating carousel 10. This constitutes a further significant difference with respect to the prior art solutions which provide an annular cam or an abutment ring (essential if pneumatic cylinders are used) both having a circumferential development equivalent to that of the carousel. In practice, this single cam 90 is not in fact designed to maintain the tubes in the desired lowered position, but is only intended to bring the tubes to this lowered position, functional to level correction. The keeping of each individual tube in the lowered position imposed by the cam 90 is in fact assigned to the reversible blocking means 70, the actuation thereof can be controlled independently for each tube by means of the control logic unit 200.

Operationally, the return of each individual tube 16 to the raised position is instead carried out by the action of the elastic mechanical means 60, of which each valve group 13 is provided. The intervention of these elastic mechanical means 60 is commanded indirectly by acting on the reversible release means. The action of the elastic mechanical means 60 is in fact released when the reversible blocking means 70 are controlled to release by the logic control unit 200. The return of each individual tube 16 to the raised position is therefore obtained mechanically, but with the flexibility offered by an electro actuated control.

In practice, this allows extremely flexible management of the moment when the return air tubes 16 are lifted by means of the logic control unit 200. Potentially, the tube of each valve group can be raised differently from the others. This allows in particular optimizing the decompression step according to the type of container format used.

The filling machine 1 according to the invention offers greater reliability with respect to filling machines with pneumatic cylinders, due to the reduced complexity of the system for adjusting the filling level and handling of the tubes.

The number of components that actively intervene in the reliability of the system is in fact larger in a filling machine with pneumatic cylinders than in a filling machine according to the invention. The malfunction or incorrect assembly of a component can affect performance. For this purpose, two examples are given:

the changed friction conditions on one of the adjustment columns of the common abutment ring can cause not only the incorrect positioning of the ring in height but also the blocking thereof;

a fitting that is not correctly installed on the pneumatic lifting circuit of the tube could cause a loss of pressure which lowers the lifting force of the tube of all the valve groups if this circuit is common to all the pneumatic cylinders.

The constructive advantages ensured by the invention are also evident:

the movable upper part of the rotating carousel is freed from level adjustment systems to the advantage of maintenance and above all cleanability of this area; and a level adjustment system (annular cam or abutment ring) which extends throughout the circumference of the carousel is substituted with a system (the cam 90 and the relative height handling means) much smaller and concentrated in a small peripheral zone of the filling machine.

In summary, the filling machine according to the invention meets the operating needs highlighted above (automatic adjustment of filling levels in case of format change and flexibility in the lifting of the return air tubes), in a simpler, more reliable and cost-effective manner compared to the currently available solutions.

The filling machine 1 is in fact capable of automatically and flexibly adjusting the filling level, adapting it to the format of the treated containers, as well as being able to automatically and flexibly manage the lowering of the return air tubes without being provided of a pneumatic cylinder or an electric motor for each tube.

Finally, the filling machine 1 according to the invention allows all filling valves to be adjusted to the same filling level without using a common abutment ring and without even providing each valve with an electric motor.

According to the embodiment illustrated in the accompanying figures, the cam 90 may be associated directly with the support structure 9 of the filling machine 1. In particular, the cam 90 may be associated with an anti-burst protection barrier 20.

Alternatively, the cam 90 may be associated with support elements separated from the support structure 9 of the rotating carousel 10.

Preferably, the means 100 for moving the cam 90 in height with respect to the support structure 9 comprise one or more electric motors 101.

Figure 3:
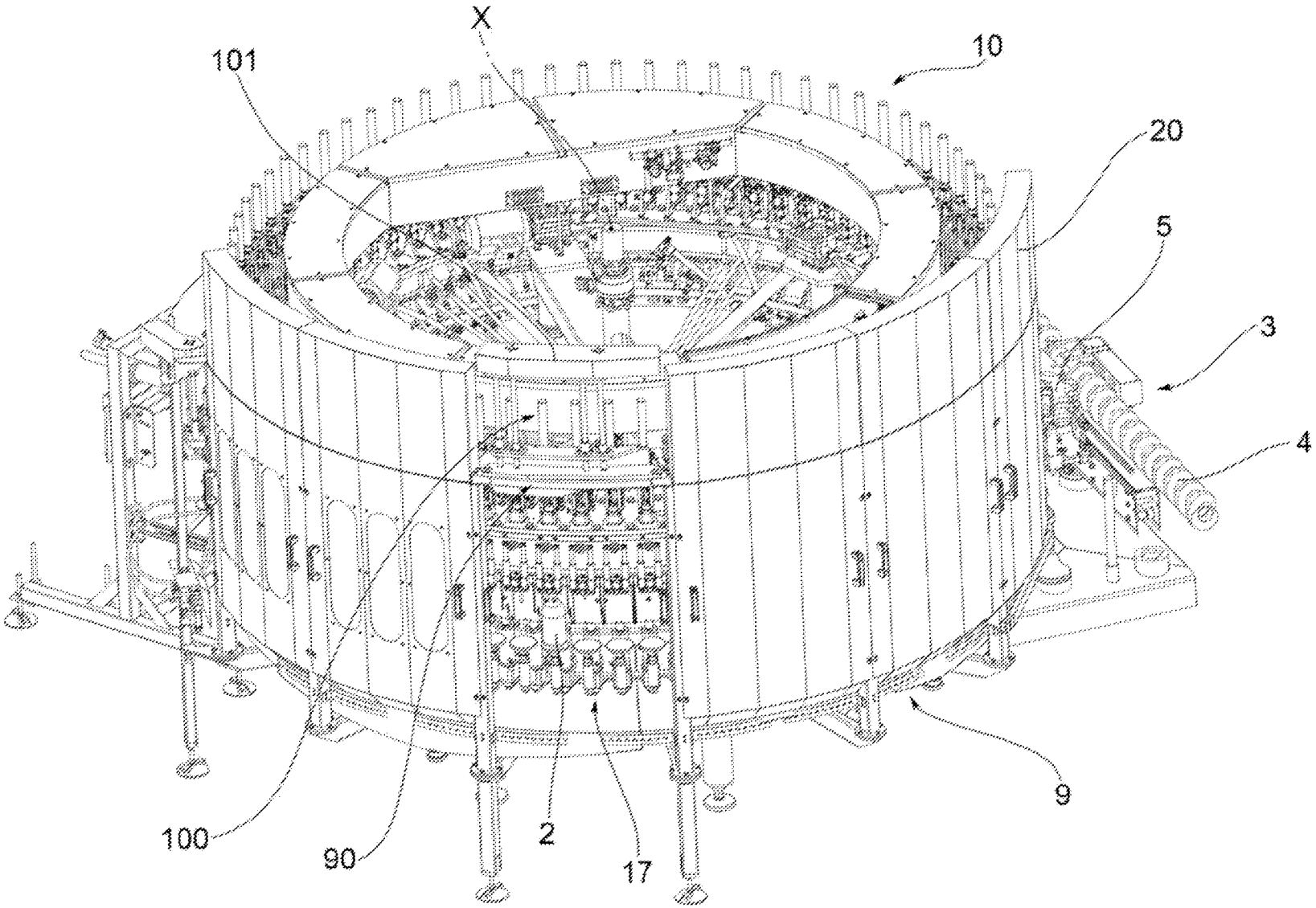

More in detail, as illustrated in FIGS. 3 and 4, the means 100 for moving the cam 90 in height comprise:—one or more guides 102 with a vertical axis, which slidably support the cam 90 in height;—one or more electric motors 101 kinematically connected to the cam 90 by one or more screw-nut systems 103. This solution allows adjusting in a flexible and precise manner the height of the cam 90 and therefore of filling level of the containers, by means of the logic control unit 200, operatively connected to the electric motors 101. The height adjustment range of the cam is defined in the design phase by fixing the distance in height between the two end stops of the cam.

According to embodiments not illustrated in the accompanying figures, the means 100 for moving the cam 90 in height with respect to the support structure 9 may comprise other reciprocating systems alternative to the electric motors, such as for example pneumatic cylinders or connecting rod-crank systems.

According to the embodiment illustrated in the accompanying figures, the cam 90 is angularly fixed with respect to the entry station 3. In other words, the aforementioned first angular position $\alpha 1$ of the cam 90 is fixed. Operatively, this means that the lowering of the return air tubes 16 always takes place in the same angular position, without the possibility of adjustment.

This obviously does not constitute an operating limit when the filling machine 1 is intended to treat a single container format, since in this case the first angular position $\alpha 1$ may be optimally defined as a function of the filling cycle of the single container format treated.

The absence of adjustment of the first angular position constitutes, however, an operating limit in the much more probable case that the filling machine is intended to treat two or more different container formats.

However, this operating limit is not particularly relevant as will be clarified below. Conversely, a lack of flexibility in raising the return air tube could instead constitute an important operating limit, since it would prevent optimal management of the decompression step. However, the filling machine 1 according to the invention does not have this operating limit, since—as already pointed out—the lifting of the tubes can be carried out flexibly by the logic control unit 200 since the return air tube 16 of each valve group 13 is operatively associated with reversible blocking means 70 and elastic mechanical means 60.

More in detail, in the (most probable) case in which the filling machine 1 is intended to treat two or more different container formats, the first angular position $\alpha 1$ will be chosen on the basis of a compromise between the requirements of the different container formats that will have to be treated by the filling machine, following the following two operational requirements:

the lowering of the tube, for each format, must take place before the filling of the bottle is finished: this requirement brings the angular position of the cam closer to the beginning of the working angle of the turret; and the lowering of the tube, for each format, must take place towards the end of filling the bottle, to increase the protection of the tube from possible bursts during filling: this requirement leads to remove the angular position of the cam from the beginning of the working angle of the turret.

By analysing the various formats of containers to be processed by the filling machine, a compromise position is chosen, also taking into account the type of product associated with the various formats, with particular reference to the filling pressure. If a product is treated at low pressure, the protection of the tube is less important, since the risk of bursting is reduced. The main requirement is the first one (lowering before the end of the filling) because it affects the maximum productivity of the filling machine with the various formats, where filling end means the angular position in which the container is completely filled, result of both the filling time and the rotation speed of the turret.

Generally, the optimal individual angular positions for each different container format that can be treated by the filling machine 1 are in fact distributed in a narrow angular sector. This derives from the fact that if for a small format the filling is temporally shorter than a larger format, the small format will, however, generally be processed at a higher rotation speed of the carousel (in order to increase the filling machine productivity). For a larger format, the filling time will be longer, but at the same time the speed of the carousel will necessarily be lower in order to ensure completion of the filling cycle. The angular positions at the end of filling for the two different formats will therefore not differ much from each other. It follows that the first compromise angular position $\alpha 1$ is in fact very close to the first optimal angular position for each format. For these reasons, the lack of flexibility in the management of the angular position of the descent of the return air tubes does not constitute a particularly important operating limit.

According to an alternative embodiment not illustrated in the accompanying figures, in order to overcome also the partial operating limits related to the lower flexibility in the lowering of the tubes, the filling machine 1 may comprise means for angularly moving the cam 90 about the axis of rotation X of the carousel 10. In fact, these means allow the first angular position $\alpha 1$ to be varied with respect to the entry station 3 of the containers in the filling machine 1 as the format of the processed containers varies.

Preferably, the angular handling means of the cam 90 are electrically controllable and the logic control unit 200 is operatively connected thereto to automatically adjust the first angular position $\alpha 1$ of the cam 90 with respect to the entry station 3 of the containers in the filling machine 1. In this way, it is possible to position the cam 90 in the optimal angular position for each different container format processed by the filling machine 1.

Preferably, as illustrated in particular in FIGS. 6 to 11, the means 50 for guiding the axial movement of the return air tube (16) comprise:

one or more linear guides 51, which are constrained to the rotating carousel 10 and extend themselves between two end supports 52 which define the two end stops; and a carriage 53, which is slidingly associated to said guides 51 and bears the cam follower 80, to which the tube 16 is rigidly constrained to move integrally therewith.

Advantageously, said one or more linear guides 51 are constrained to the rotating carousel 10 on the top 12' of the tank 12 to extend themselves in height outside said tank. The tube 16 is rigidly constrained to the carriage 53 at a portion thereof, which stays outside the tank 12. This configuration is advantageous as it ensures a more immediate maintainability of the system, being accessible from the outside.

Preferably, the elastic mechanical means 60 of each individual tube 16 are operatively associated to the axial guide means 50 and are suitable to Indirectly exert their thrust on the tube 16 acting on the carriage 53.

Figure 8:
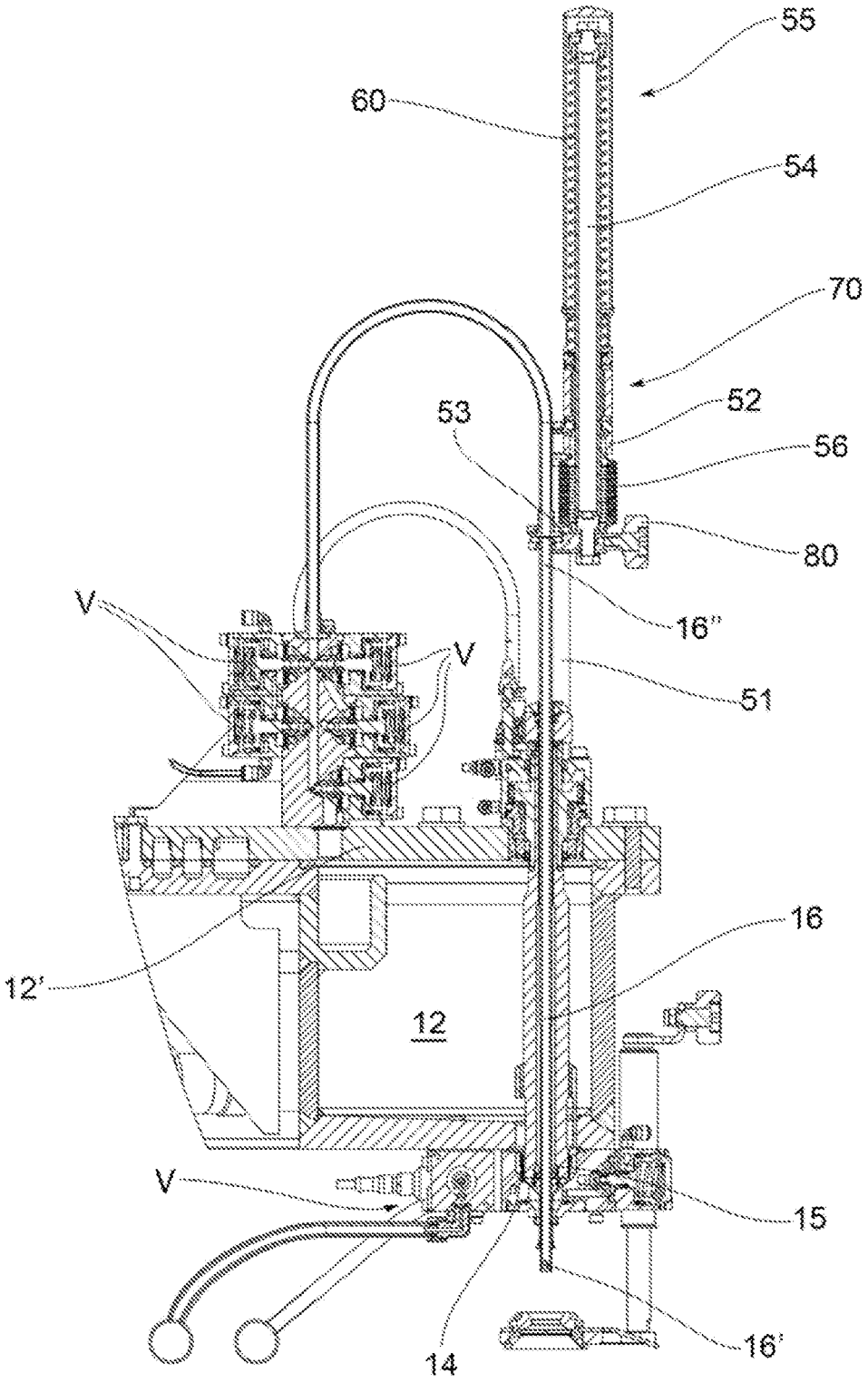
FIG. 8 shows an orthogonal sectional view of the filling valve shown in FIG. 7, according to a radial section plane passing through the return air tube of said valve.
Figure 9:
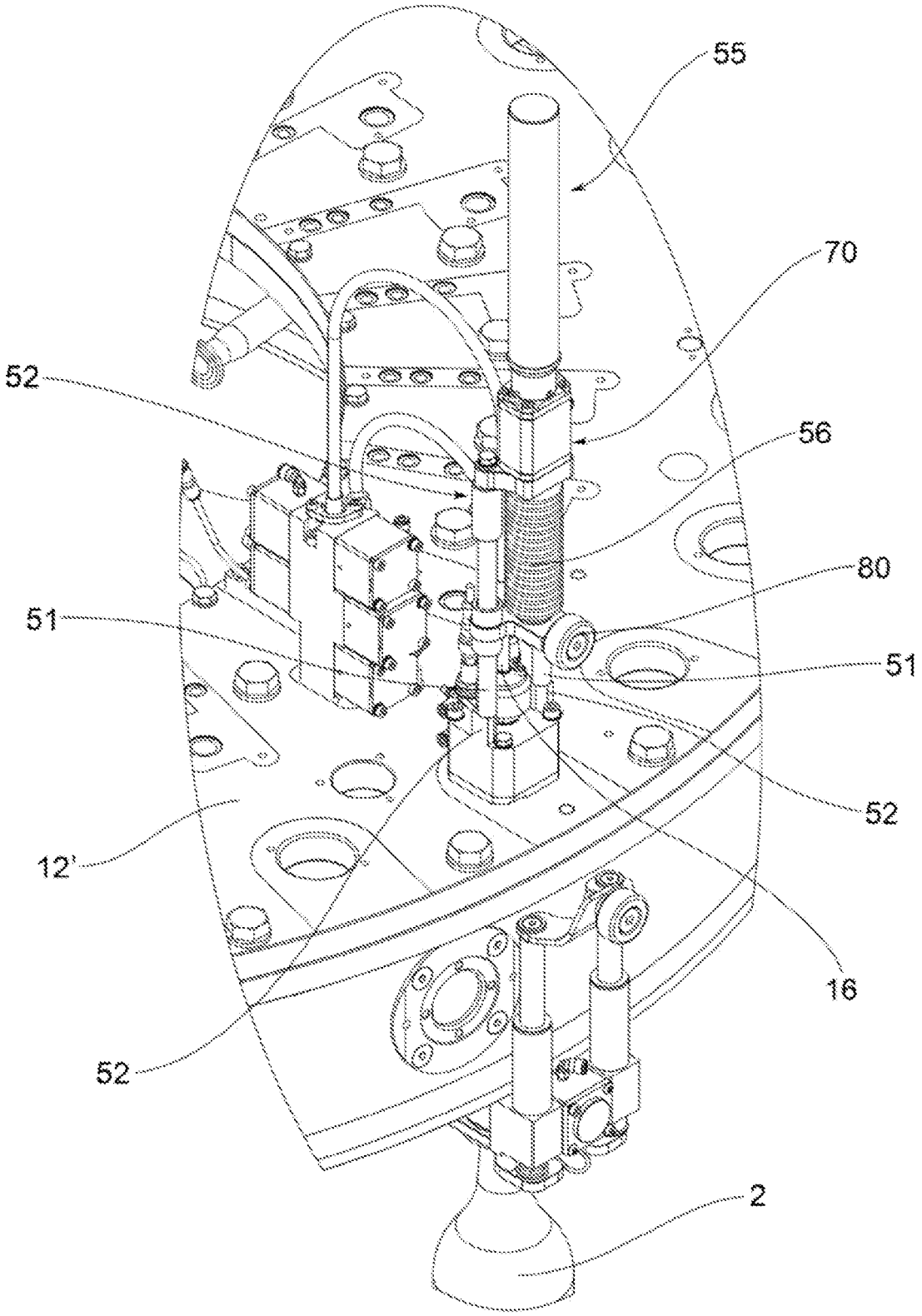
FIG. 9 shows the valve in FIG. 7, illustrated with the return air tube in a lowered position.
Figure 10:
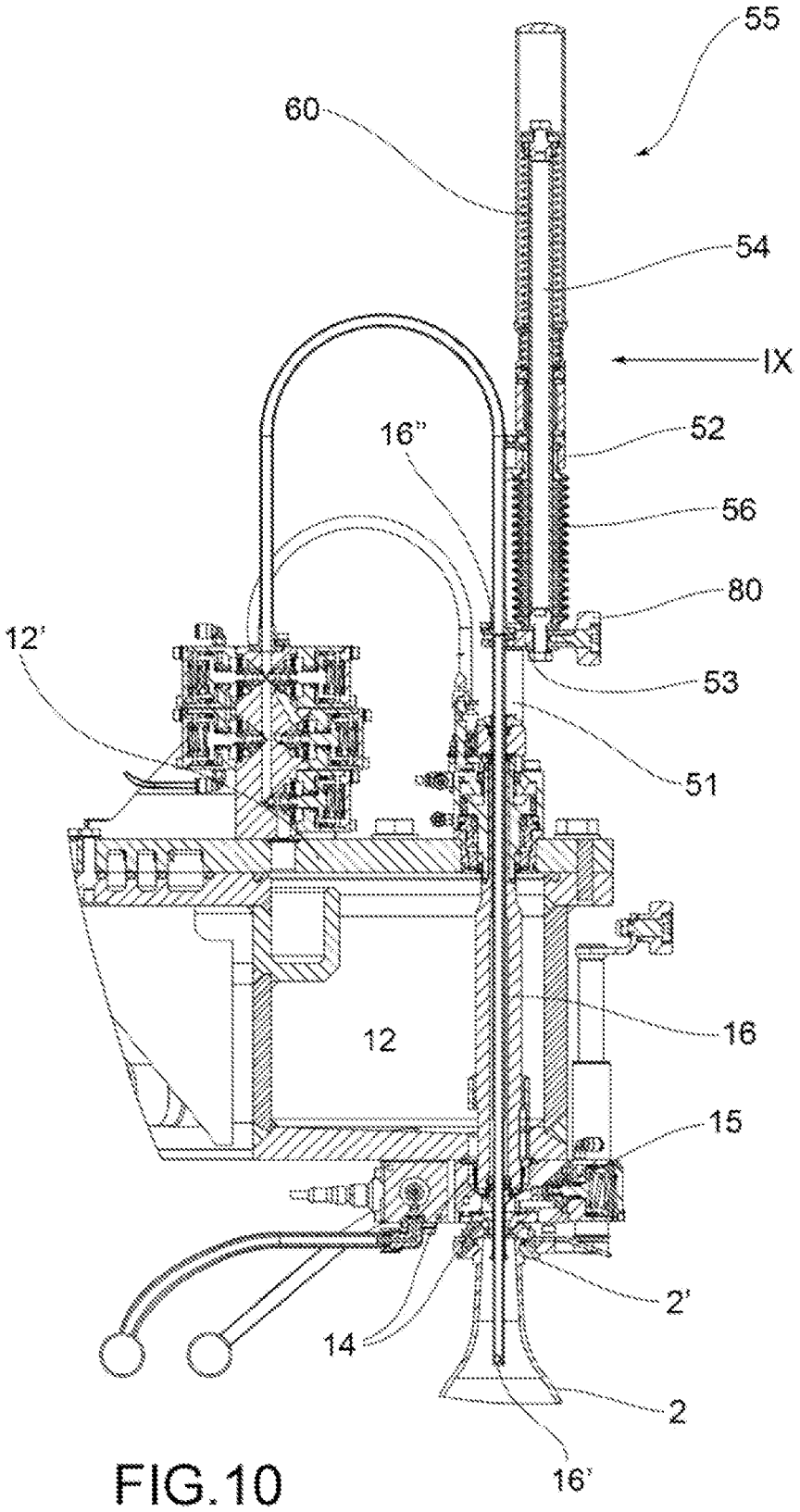
FIG. 10 shows an orthogonal sectional view of the filling valve shown in FIG. 9, according to a radial section plane passing through the return air tube of said valve.

More in detail, as illustrated in particular in FIGS. 8 and 10, the carriage 53 is provided with a rod 54 rigidly fixed thereto to extend itself in height parallel to said one or more guides 51. Said elastic mechanical means consist of a mechanical coil spring 60 which is mounted coaxially to the rod 54 to act in thrust between said rod and a support 52 of said one or more guides 51.

Preferably, said rod 54 is axially inserted inside a protective sheath 55 intended to protect the rod from dirt deposit. In particular, said sheath 55 comprises at least an axially deformable portion 56 (for example, consisting of a bellows seal) and is associated with the rod 54, so as to ensure the protection of the rod 54 in any position.

Preferably, the reversible blocking means 70 of the return air tube 16 act on the rod 54 to reversibly block the axial movement thereof with respect to said one or more guides 51.

Preferably, the reversible blocking means consist of an electro-pneumatically actuated friction blocking device 70.

Figure 11:
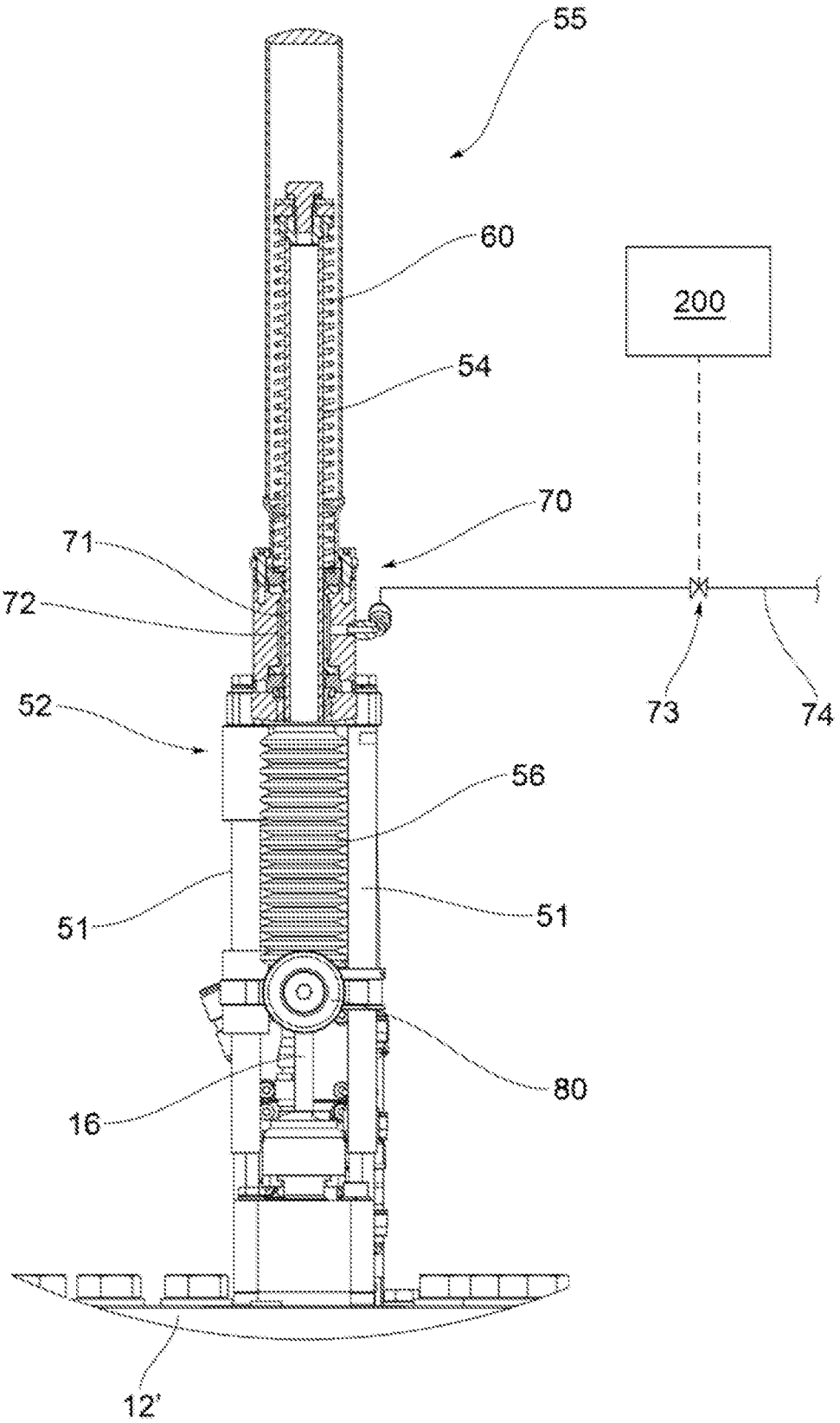
FIG. 11 shows an orthogonal partially sectional view of a detail of the filling valve shown in FIG. 10 according to the arrow XI shown therein, regarding a guide, lifting and blocking system of the return air tube.

According to the illustrated embodiment of the accompanying Figures, and in particular in FIG. 11, said electro-pneumatically actuated friction blocking device 70 comprises an elastically deformable sleeve 71 mounted coaxially on said rod 54 inside a closed chamber 72 connected to a pressurised gas circuit (shown schematically in FIG. 11).

Operationally, the aforesaid sleeve 71 is susceptible to shift upon a variation of the internal pressure of the chamber 72 between:

a position of adherence to the rod, in which the sleeve 71 prevents the axial sliding of the rod 54 exerting thereon sufficient friction to overcome the action of the elastic mechanical means 60; and a position of non-adherence, wherein the sleeve 71 permits the axial sliding of the rod 54 not exerting thereon sufficient friction to overcome the action of the elastic mechanical means 60.

Operationally, the passage between said two positions is controlled pneumatically by means of a solenoid valve 73 which is suitable to control the inflow of pressurised gas inside said chamber 72 and is operatively connected to the logic control unit 200.

Alternatively, the reversible blocking means may consist of an electro-mechanical or electro-magnetic blocking device.

Advantageously, each valve group 13 may comprise a level sensor, suitable for carrying out a first level definition with an alternative mode to the hydraulic one through the return air tube. Preferably, such a level sensor is associated with the return air tube 13 and is thus moved together with it. Operatively, the correction of the filling level by means of the return air tube is in any case carried out.

Preferably, the filling machine 1 is an isobaric filling machine. The logic control unit 200 is programmed in such a way that depending on the format of container handled by the filling machine 1 the second angular position $\alpha 2$ is chosen ensuring that the return of the tube to the raised position occurs before a decompression phase of the container.

The invention thus conceived thus achieves the intended purposes.

The invention claimed is:

1. A machine for filling containers with liquids, provided with a filling level correction system, which comprises:

a support structure;

a rotating carousel rotatably mounted on said support structure, and provided with a tank for containing a liquid to be bottled in containers;

a plurality of valve groups mounted peripherally on said rotating carousel each responsible for filling a container; and a logic control unit suitable to automatically manage the operation of said filling machine, wherein each valve group comprises:

a supply duct hydraulically connected to said tank for the inflow of said liquid from said tank into said containers to be filled;

a shutter placed to intercept said supply duct to adjust the inflow of said liquid into said containers;

a return air tube which is mounted coaxially inside said supply duct and is provided with an open lower end, susceptible to be inserted in said container, and a upper end, which is opposite said lower end and can be connected hydraulically to said tank or to a separate drainage circuit, said return air tube being movable axially between at least one lowered position and a raised position, regardless of said shutter; and a duct which can be fluidically connected to a pressurised gas circuit to introduce gas into the container at the end of filling and thus expel through said tube the excess liquid that may have filled the container beyond the height at which the lower end of the return air tube is placed, corresponding to said lowered position, thereby performing a correction of the filling level, wherein each valve group comprises:

means for guiding the axial movement of the return air tube between a lower end stop and an upper end stop, wherein said at least one lowered position is between said two end stops;

elastic mechanical means suitable to exercise constantly an axial thrust action on said return air tube towards said raised position;

means for reversibly blocking the return air tube in any axial position between said lower end stop and said upper end stop; and a cam follower rigidly connected to said return air tube;

and wherein said filling machine comprises a cam which is placed peripherally to said rotating carousel at a first angular position $\alpha 1$ with respect, to an entry station to be cyclically engaged by the cam follower of each valve group, wherein said cam is profiled so as to impose on each tube by means of the relative cam follower a predetermined axial displacement H from a position corresponding to the upper end stop towards said lower end stop, overcoming the opposite thrust of said elastic mechanical means and placing the tube in a lowered position with respect to the position corresponding to the upper end stop, said cam having an operating angle of working $\Delta$ which covers only a portion of the circumferential extension of the rotating carousel, and wherein said filling machine comprises means for moving the cam in height in relation to said support structure in order to adjust the height corresponding to said lowered portion, and wherein the logic control unit is operatively connected to the means for moving the cam in height to adjust automatically the height corresponding to said lowered position, as well as to the reversible blocking means of each return air tube so as to command the blocking and unblocking action, wherein said logic control unit is programmed:

to command the blocking of the reversible blocking means of each individual return air tube when the individual tube is located within the operating angle of working $\Delta$ of the cam to keep the return air tube in the lowered position which it was brought to by said cam itself, opposing the action of the elastic mechanical means, and to command the unblocking of the reversible blocking means of each individual air return tube at a second angular position $\alpha 2$ chosen as a function of the filling operating cycle to be performed on the containers, so as to allow the return of the individual tube to the raised position under the action of the relative elastic mechanical means, said second angular position $\alpha 2$ being placed downstream of the first angular position $\alpha 1$ and upstream of an exit station 6.

2. The filling machine according to claim 1, wherein the cam is attached directly to said support structure or is associated to support elements separate from the support structure of the rotating carousel.

3. The filling machine according to claim 1, wherein the means for moving the cam in height in relation to said support structure comprise one or more electric motors.

4. The filling machine according to claim 1, wherein the first angular position $\alpha 1$ of the cam is fixed.

5. The filling machine according to claim 1, comprising means for angularly moving the cam around the axis of rotation of the carousel in order to vary the first angular position $\alpha 1$ with respect, to the entry station of the containers in the filling machine.

6. The filling machine according to claim 5 wherein the logic control unit is operatively connected to the angular movement means or the cam to automatically adjust the first angular position $\alpha 1$ of the cam with respect to the entry station of the containers in the filling machine.

7. The filling machine according to claim 1, wherein the means for guiding the axial movement of the return air tube comprise:—one or more linear guides, which are constrained to the rotating carousel and extend themselves between two end supports which define the two end stops; and—a carriage, which is slidingly associated to said guides and bears the cam follower, the tube being rigidly constrained to said carriage to move integrally therewith.

8. The filling machine according to claim 7, wherein said one or more linear guides are constrained to the rotating carousel on the top of the tank to extend themselves in height outside said tank, and wherein the tube is rigidly constrained to the carriage at a portion thereof which stays outside the tank.

9. The filling machine according to claim 7, wherein the elastic mechanical means of each individual tube are operatively associated to the axial guide means and are suitable to indirectly exert their thrust on the tube acting on the carriage.

10. The filling machine according to claim 9, wherein the carriage is provided with a rod rigidly fixed to it to extend itself in height parallel to said one or more guides, and wherein the elastic mechanical means consist of a mechanical coil spring which is mounted coaxially to said rod to act in thrust between said rod and a support of said one or more guides.

11. The filling machine according to claim 10, wherein said rod is axially inserted inside a protective sheath, preferably said sheath comprising at least one axially deformable portion associated with said rod.

12. The filling machine according to claim 10, wherein the reversible blocking means of the return air tube act on said rod to reversibly block the axial movement with respect to said one or more guides.

13. The filling machine according to claim 1, wherein the reversible blocking means consist of an electro-pneumatically actuated friction blocking device.

14. The filling machine according to claim 12, wherein the reversible blocking means consist or an electro-pneumatically actuated friction blocking device and wherein said electro-pneumatically actuated friction blocking device comprises an elastically deformable sleeve mounted coaxially on said rod inside a closed chamber connected to a pressurised gas circuit, wherein said sleeve is susceptible to shift upon a variation of the internal pressure of said chamber between a position of adherence to the rod, in which the sleeve prevents the axial sliding of the rod exerting thereon sufficient friction to overcome the action of the elastic mechanical means and a position of non-adherence, wherein the sleeve permits the axial sliding of the rod not exerting thereon sufficient friction to overcome the action of the elastic mechanical means, the passage between said two positions being controlled pneumatically by means of a solenoid valve which is suitable to control the inflow of pressurised gas inside said chamber and is operatively connected to the logic control unit.

15. The filling machine according to claim 1, wherein each valve group comprises a level sensor, preferably associated with the return air tube.

16. The filling machine according to claim 1, characterised in that it is an isobaric filling machine wherein the logic control unit is programmed in such a way that depending on the format of container handled by the filling machine the second angular position $\alpha$2 is chosen ensuring that the return of the tube to the raised position occurs before a decompression phase of the container.

* * * * *